United States Patent [19]

O'Shea et al.

[11] Patent Number: 4,617,539

[45] Date of Patent: Oct. 14, 1986

[54] REFLECTIVE PHASE SHIFTER

[75] Inventors: Richard L. O'Shea, Holliston, Mass.; Philip R. Merrill, Nashua, N.H.

[73] Assignee: Raytheon Company, Lexington, Mass.

[21] Appl. No.: 733,350

[22] Filed: May 13, 1985

[51] Int. Cl.[4] ..... H01P 1/185

[52] U.S. Cl. ..... 333/164; 333/156; 333/160; 333/262

[58] Field of Search ..... 333/156, 157, 160, 164, 333/124–126, 245, 259, 262

[56] References Cited

U.S. PATENT DOCUMENTS 3,423,699 1/1969 Hines ..... 333/160 X 3,629,739 12/1971 Barber et al. ..... 333/156 X

*Primary Examiner*—Marvin L. Nussbaum

*Attorney, Agent, or Firm*—Scott W. McLellan; Philip J. McFarland; Richard M. Sharkansky

[57] ABSTRACT

A digitally controlled reflective type phase shifter wherein radio frequency energy is fed to an input/output port of the phase shifter and then coupled from the phase shifter at the input/output port, the phase shifter providing one of a plurality of predetermined phase shifts between the fed energy and the coupled energy selectively in accordance with a control signal. The phase shifter includes: a coaxial transmission line with an inner conductor and an outer conductor, a first end of the inner conductor and a first end of the outer conductor providing the input/output port; a conductor connected to the second end of the outer conductor, such conductor being dielectrically spaced from a second end of the inner conductor; and, a plurality of switches, disposed between different portions of the second end of the inner conductor and the conductor and responsive to a control signal, for electrically connecting a selected one or ones of said different portions of the second end of the inner conductor to the conductor while unselected ones of the different portions of the second end of the inner conductor remain dielectrically spaced from the conductor.

14 Claims, 7 Drawing Figures

FIG. 5
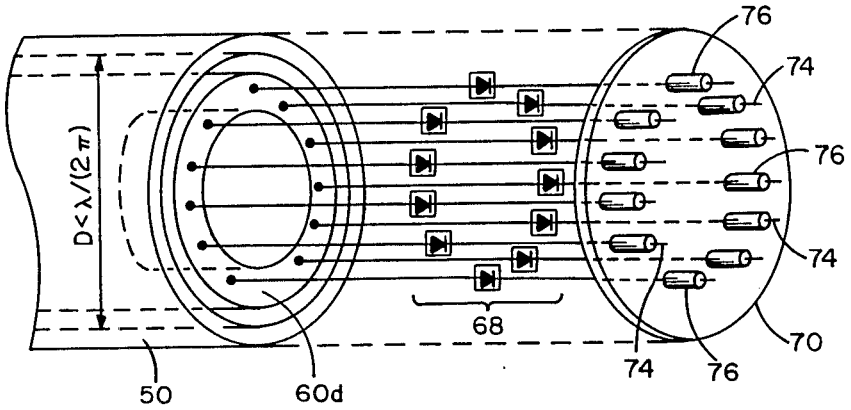
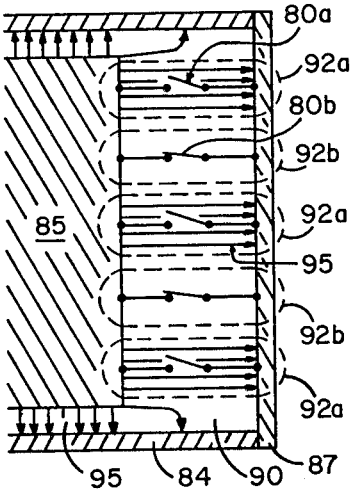
FIG. 7
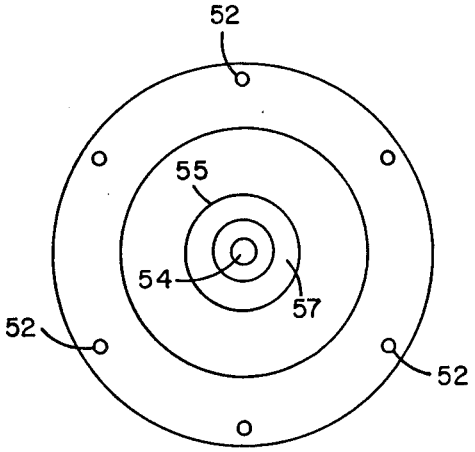
FIG. 3
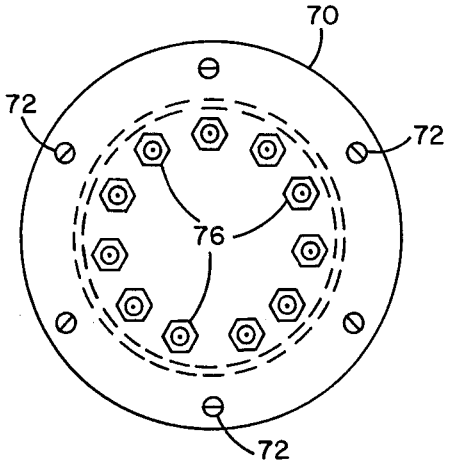
FIG. 4

REFLECTIVE PHASE SHIFTER

BACKGROUND OF THE INVENTION

This invention relates generally to reflective phase shifters, and more particularly, to high power digitally controlled reflective phase shifters.

In some phased array radars, a plurality of digitally controlled phase shifters are coupled to a corresponding plurality of antenna elements to produce a collimated and directed beam of radio frequency (RF) energy. One such digitally controlled reflective phase shifter selectively couples one of a number of impedances to a transmission line to provide that transmission line with one of a plurality of reflection coefficients and, hence, RF energy introduced into, and reflected from, the phase shifter is phase shifted an amount related to the one of a plurality of reflection coefficients provided by the selected impedance. Corresponding PIN diodes couple the impedances to the transmission line. Combinations of the different impedances yield different phase shifts, but power handling capacity of that phase shifter is limited to that of a single impedance component and the corresponding PIN diodes. Power handling capacity is thus limited to the power capacity of a single PIN diode. Therefore, for high power operation, the use of high power-high cost diodes, or the paralleling of many diodes to share power dissipation is required.

SUMMARY OF THE INVENTION

In accordance with the present invention, a digitally controlled reflective type of phase shifter is provided herein allowing high power handling capability and low loss in a compact package. This reflective type phase shifter imparts a predetermined phase shift between radio frequency energy entering the reflective type phase shifter and exiting therefrom after being reflected therein. The reflective type phase shifter has a coaxial transmission line having: an inner conductor and an outer conductor, a first end providing an input to enter the radio frequency energy and providing an output to exit the reflected phase shifted radio frequency energy; an end conductor coupling to a second end of the outer conductor spaced from a second end of the inner conductor a predetermined distance; and, a plurality of switch means, disposed between selected portions of the end of the inner conductor and corresponding selected portions of the end conductor, for electrically coupling the selected portions of the inner conductor to the selected portions of the end conductor in accordance with corresponding control signals. Also, in accordance with the present invention there are a plurality of serially coupled quarter-wave transformer means for electrically transforming radio frequency energy from a relatively high input impedance to a relatively low impedance output, a means coupling to a first one of the plurality of serially coupled quarter-wave transformer means for entering therein and exiting therefrom the radio frequency energy, and a last one of the plurality of serially coupled quarter-wave transformer means coupling to the first end of the coaxial transmission line, wherein the coaxial transmission line has substantially the same characteristic impedance as the relatively low impedance output of the last one of the plurality of serially coupled quarter-wave transformer means.

Further, in accordance with the present invention, a reflective type phase shifter is provided for imparting a predetermined phase shift between radio frequency energy entering the reflective type phase shifter and exiting therefrom after being reflected therein, having: a coaxial transmission line with an inner conductor and an outer conductor, a first end providing an input to enter radio frequency energy and providing an output to exit the reflected, phase shifted radio frequency, an end conductor coupling to a second end of the outer conductor and spaced from a second end of the inner conductor a predetermined distance, and a plurality of switch means, disposed between selected portions of the second end of the inner conductor and corresponding selected portions of the endplate for electrically coupling the selected portions of the inner conductor to the selected portions of the endplate in accordance with control signals to place such selected portions of the inner and end conductors at substantially the the same electrical potential while unselected portions are at different electrical potentials. Also, the end conductor coupling to the second end of the outer conductor and spaced from the second end of the inner conductor a predetermined distance forms a non-resonant cavity at the nominal operating frequency of the phase shifter.

BRIEF DESCRIPTION OF THE DRAWINGS

The foregoing features of this invention, as well as the invention itself, may be more fully understood from the following detailed description of the drawings, in which:

FIG. 3 is an end view of one phase shifter of the network in FIG. 1;

FIG. 4 is an end view of the endplate 70 of one phase shifter of the network in FIG. 1;

FIG. 5 is an exploded view of the top portion of one phase shifter of the network in FIG. 1;

FIG. 7 is a cross-sectional view of the switch means end of the representative phase shifter in FIG. 6 showing selected portions of an inner conductor and an end conductor and higher order modes in the unselected portions thereof.

DESCRIPTION OF THE PREFERRED EMBODIMENT

Figure 1:
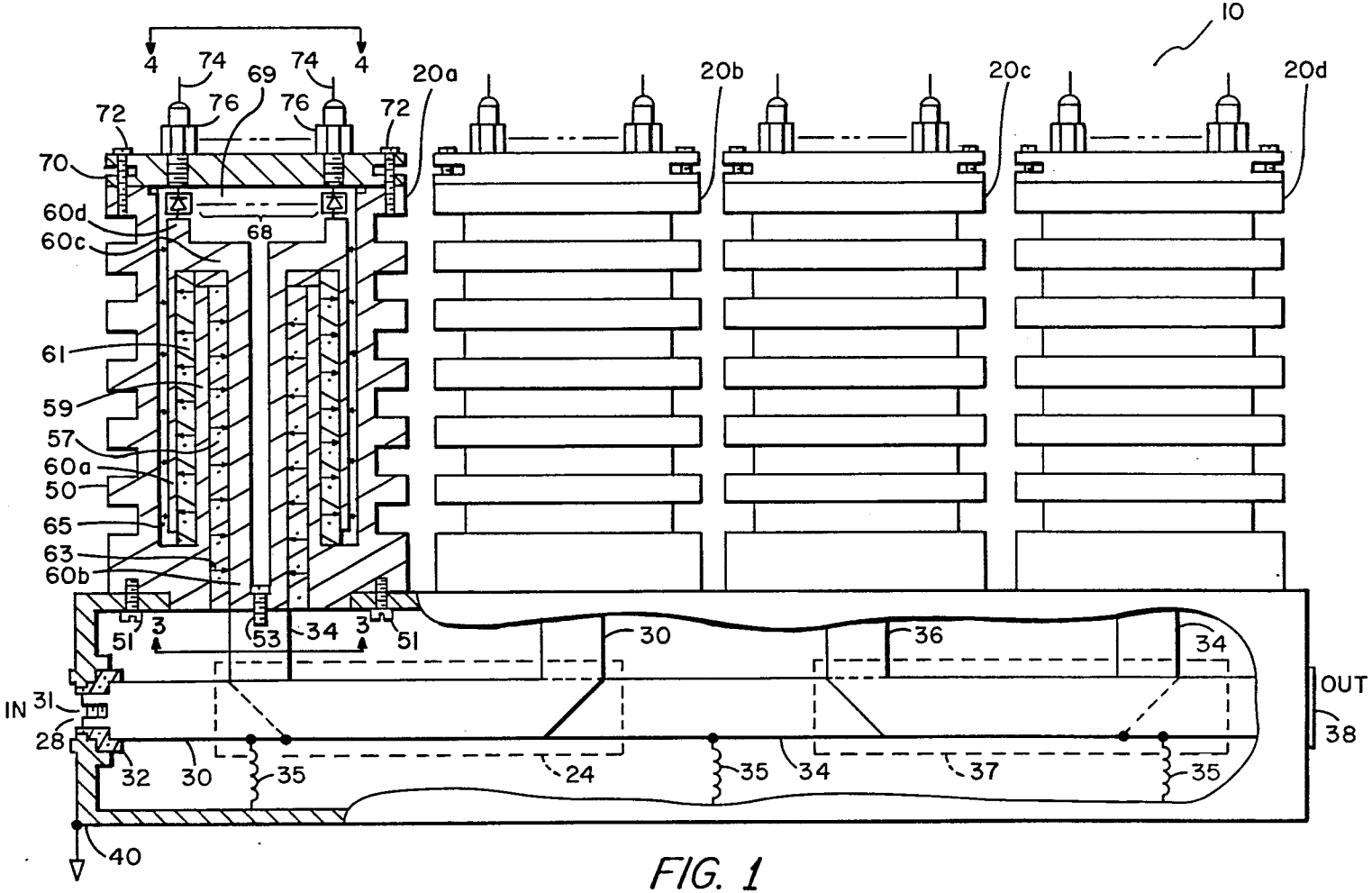
FIG. 1 is a 0°–360° phase adjusting network with an exemplary one of four phase shifters according to the invention being shown partially cut away.
Figure 2:
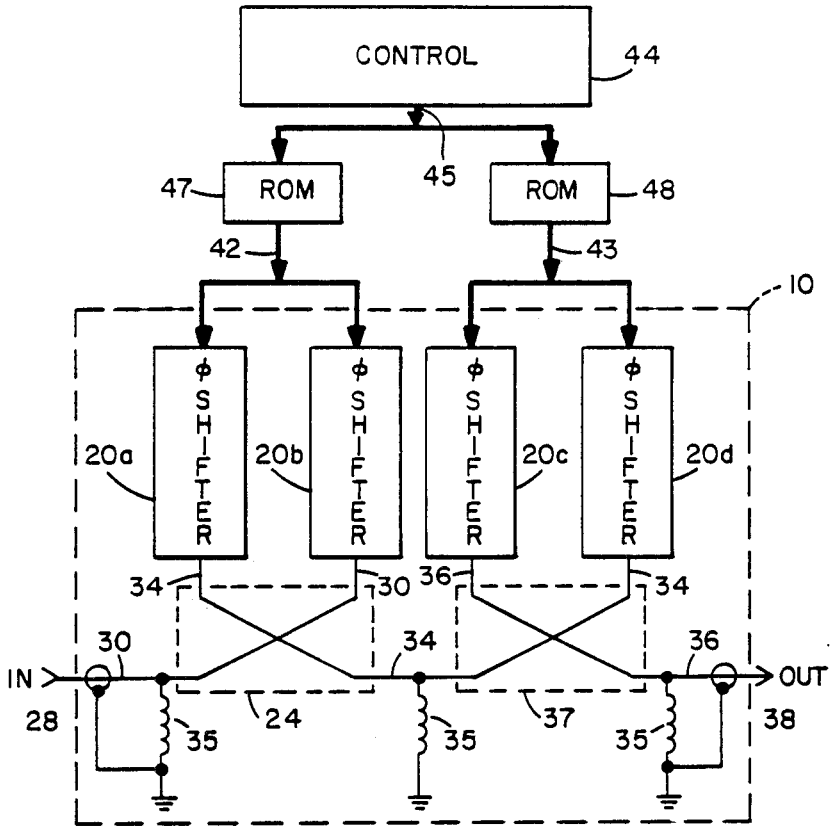
FIG. 2 is a schematic diagram of a system using the 0°–360° phase adjusting network of FIG. 1.

Referring to FIGS. 1 and 2, a phase adjusting network 10 is shown to include four digitally controlled phase shifters 20*a*–20*d*. Each one thereof shifts the phase an outgoing (reflected) radio frequency (RF) energy relative to an input RF signal from 0° to 180°. First two of the four digitally controlled phase shifters 20*a*, 20*b* is coupled to a first hybrid 24, and a second two of the four digitally controlled phase shifters 20*c*, 20*d* is coupled to a second hybrid 37. RF energy to be phase shifted is applied to input connector 28. Connector 28 is typically a $\frac{7}{8}$ inch flange coaxial connector, as specified by specification Mil-F-24044/1. Connector 28 has a conductor 30 which protrudes through an opening in case 40 (case 40 being grounded) and is insulated therefrom by insulating spacer 32. A threaded hole 31 is provided for receiving a threaded mating connector.

Conductor 30 is a first one of two conductors forming hybrid 24 and couples one output of first hybrid 24 to phase shifters 20*b*. Conductor 34, the second one of two conductors forming first hybrid 24, terminating output of first hybrid 24, input of second hybrid 37, and first one of two conductors forming second hybrid 37, couples phase shifter 20*a* to one output of first hybrid 24 and one output of second hybrid 37 to phase shifter 20*d*. Conductor 36, second one of two conductors forming second hybrid 37, couples phase shifter 20*c* to one output of second hybrid 37 and terminating output second hybrid 37 to output connector 38. Output connector 38 is substantially the same as input connector 28. Both first hybrid 24 and second hybrid 37 are quarter-wave hybrids. Phase shifted RF energy is reflected by each phase shifter 20*a*, 20*b* from input RF energy constructively interfere at the output of first hybrid 24, while destructive interference between the two phase shifted RF energies occurs at the input to first hybrid 24. Therefore, for maximum efficiency, both phase shifters 20*a*, 20*b* must be matched as closely as possible, i.e., each phase shifter 20*a*, 20*b* must produce the same phase shift so that no power is reflected back to the input connector 28 and all power passes from input connector 28 to the terminating output of first hybrid 24. The foregoing discussion also applies to second hybrid 37 and phase shifters 20*c*, 20*d*. RF chokes 35 couple conductors 30, 34 and 36 to ground via case 40 thereby bypassing any direct current flowing in those conductors to ground while the RF energy on those conductors are unaffected.

Referring now also to FIG. 2, each two of the four digitally controlled phase shifters 20*a*, 20*b* and 20*c*, 20*d* is shown to have common control signals, e.g., bus 42 couples to digitally controlled phase shifters 20*a*, 20*b* and bus 43 couples to digitally controlled phase shifters 20*c* and 20*d*. Control 44 places signals on bus 45 corresponding to a desired phase shift is coupled to ROMs 47, 48 which generate corresponding preselected control signals to phase shifters 20*a*–20*d* by buses 42, 43.

Figure 6:
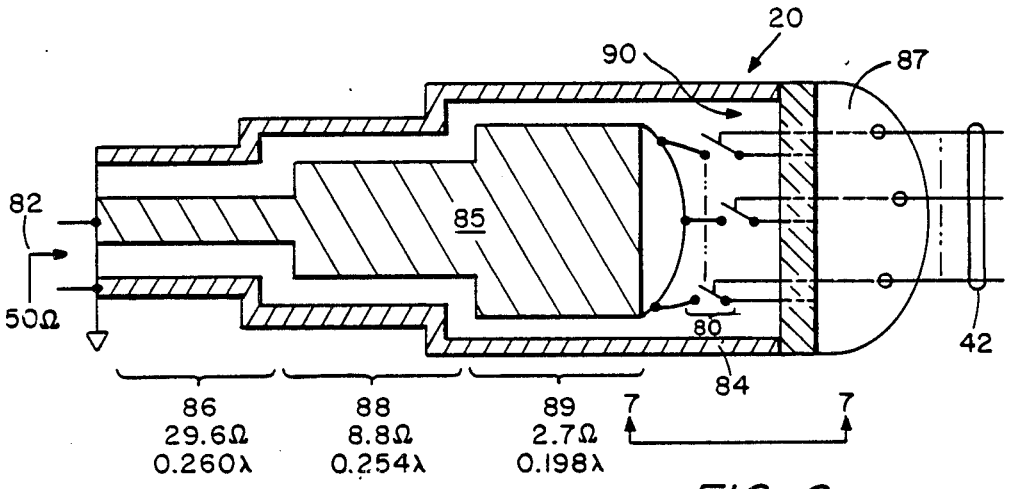
FIG. 6 is a representation of one phase shifter of the network in FIG. 1 with three quarter-wave transformers in tandem and the arrangement of the switch means.

Referring to FIG. 1, a detailed cross section of an exemplary phase shifter 20*a* is shown. Housing 50 of phase shifter 20*a* is secured to outer wall 40 by screws 51. Housing 50 surrounds two concentric cylindrical conductors 60*a*, 60*b* and a ring conductor 60*d* having a common shorting plate 60*c*. Screw 53 secures conductor 34 to cylindrical conductor 60*b*. (FIG. 3 is a view of a lower portion of the phase shifter 20*a*.) Cylindrical conductor 60*b* is isolated from housing 50 by a suitable dielectric sleeve 57. Holes 52 receive screws 51 and hole 54 holds screw 53 from cylindrical conductor 60*b* to couple to conductor 34 (FIG. 1). Note that sleeve 57 (FIG. 1) extends along cylindrical conductor 60*b*, as a dielectric for a coaxial waveguide formed by cylindrical conductor 60*b* and inner wall of sleeve 59. Sleeve 59 is coupled to housing 50. The length of this coaxial waveguide is approximately a quarter-wave at the nominal operating wavelength and has a lower characteristic impedance than the impedance of the input conductor 34, hence it is a quarter-wave transformer transforming a relatively high impedance input to a relatively low impedance output, here a first quarter-wave transformer. Cylindrical conductor 60*a*, electrically coupled to cylindrical conductor 60*b* by shorting plate 60*c*, forms a second quarter-wave transformer between inner wall of cylindrical conductor 60*b* and outer wall of sleeve 59, through dielectric 61. A third quarter-wave transformer is formed by an outer wall of cylindrical conductor 60*b* and an inner wall of housing 50. For clarity, an E field of exemplary Transverse Electric Mode (TEM) RF energy in the phase shifter 20*a* is shown by representative arrows 63, 64 and 65. The E field of incident TEM RF energy from conductor 34 propagates along cylindrical conductor 60*b* as shown by arrow 63. This RF energy propagates until it reaches a free end of sleeve 59 where the RF energy reverses direction into the second quarter-wave transformer. The E field 64 of RF energy in the second quarter-wave transformer propagates until it reaches the free end of cylindrical conductor 60*a* where the RF energy again reverses direction and propagates through the third quarter-wave transformer. The E field 65 of the RF energy in the third quarter-wave transformer propagates until it reaches the end of cylindrical conductor 60*a*. Hence, the three quarter-wave transformers are folded together such that the length of the three quarter-wave transformers is approximately that of a single quarter-wave transformer. A plurality of diodes 68, here eleven PIN diodes in cavity 69 (such cavity being a non-resonant cavity for reasons discussed hereinafter), electrically couple different portions of ring conductor 60*d* to electrically conductive endplate 70, ring conductor 60*d* being coupled to cylindrical conductor 60*a* by shorting plate 60*c*, selectively in accordance to control signals supplied to diode 68 via conductor 74 and low pass filter 76. Electrically conductive endplate 70, which forms along with housing 50 the outer conductor of the third quarter-wave transformer, is secured to housing 50 by screws 72. Note that RF chokes 35 (FIGS. 1, 2) provide a D.C. return to ground for control signals passing through the diodes 68. Circumference of the inner wall of housing 50 in non-resonant cavity 69 is less than one half wavelength ($D\pi < \lambda/2$), so that higher order modes excited by the selective coupling of different portions of conductor 60 to electrically conductive endplate 70 in non-resonant cavity 69 by incoming RF energy will not propagate out of the phase shifter 20*a*. Thus, by limiting the circumference to less than one half wavelength, the non-resonant cavity 69 is "beyond cutoff" for these higher order modes. The lowest order (i.e. dominant) mode being where all PIN diodes 68 are off and the E field of RF energy in the non-resonant cavity 69 is uniformly distributed. FIG. 4 diagrams cover plate 70. Screws 72 secure endplate 70 to housing 50 (FIG. 1), thereby covering the unterminated end of the ring conductor 60*d*, and eleven low pass filters 76 are arranged symmetrically about a circle, that circle having a diameter approximately that of ring conductor 60*d* (FIG. 1) and aligned axially with their corresponding diodes 68. FIG. 5 is an exploded view of the top portion of a phase shifter 20. Diodes 68 arranged axially and symmetrically about the periphery of ring 60*d*, have anodes of diodes 68 coupling to the ring conductor 60*d*. Cathodes of diodes 68 couple to corresponding low pass filters 76 which are mounted on endplate 70. Control signals that control individual diodes 68 are applied to conductor 74. Diameter D of the inner wall of housing 50 is shown to be less than one-half wavelength over pi ($\lambda/(2\pi)$) so that the circumference of the inner wall of housing 50 is less than one-half wavelength as described above. Such arrangement allows four bits of accuracy for a phase shift from 0° to 180° for each pair of phase shifters 20*a*, 20*b* and 20*c*, 20*d* yielding a step size is 11.25° which diodes 68 are enabled to achieve the desired phase shift is done empirically by selectively enabling selected diodes 68 to yield the desired phase shift with minimum loss, and that data is stored in ROMs 47, 48 (FIG. 2). For minimum power dissipation in each phase shifter 20*a*–20*d* and for a given phase shift, e.g. 180°, each phase shifter 20*a*–20*d* has selected diodes 68 enabled as to produce 90° of phase shift in each phase shifter 20*a*–20*d*, thereby having 90° of phase shift out of first hybrid 24 and 90° of phase shift out of second hybrid 37, resulting in a phase shift of 180°. Since there are two pairs of phase shifters 20*a*, 20*b* and 20*c*, 20*d*, each pair with four bits of accuracy, combining them yields a 0°–360° phase shifter having five bits of accuracy. To better understand how phase shifter 20 operates and is constructed, FIG. 6 shows the phase shifter 20 with three quarter-wave transformers extended end to end, as opposed to being folded together, and diodes 68 (FIG. 1) represented by switches 80. Input RF signals to 50 ohm input port 82 propagate down coaxial transformer 86, corresponding to the first quarter-wave transformer formed by the cylindrical conductor 60*b* and the inner wall of sleeve 59 (FIG. 1), formed by outer conductor 84 and inner conductor 85. The electrical length of coaxial transformer 86 is here 0.260 wavelength, approximately one quarter wavelength, and has a characteristic impedance of 29.6 ohms. A second coaxial transformer 88, corresponding to the second quarter-wave transformer formed by the inner wall of cylindrical conductor 60*a* and the outer wall of sleeve 59 (FIG. 1), has an electrical length of 0.254 wavelength, approximately one quarter wavelength, and has a characteristic impedance of 8.8 ohms. A third coaxial transformer 89, corresponding to the third quarter-wave transformer formed by the outer wall of cylindrical conductor 60*a* and the inner wall of housing 50 (FIG. 1), has an electrical length of 0.198 wavelength, approximately one quarter wavelength, and has a characteristic impedance of 2.7 ohms. Output from coaxial transformer 86 is coupled to input of coaxial transformer 88, and output of coaxial transformer 88 is coupled to the input of coaxial transformer 89 by having a common inner conductor 85 and a common outer conductor 84. An end conductor 87, equivalent to the electrically conductive endplate 70 (FIG. 1), is coupled to the end of outer conductor 84, spaced from inner conductor 85 to form a cavity 90. This cavity 90 is equivalent to non-resonant cavity 69 (FIG. 1) and is also non-resonant by having the circumference of the inner wall of outer conductor 84 less than one-half wavelength. Signals on control bus 42 selectively enable switch means 80, disposed in cavity 90, to electrically couple selected portions of inner conductor 85 to selected portions of outer conductor 84. FIG. 7 is a cross-sectional view of the switch means end of a phase shifter 20 from FIG. 6 showing switch means 80*a*, 80*b* and selected portions 92*a*, 92*b* of the inner conductor 85 and end conductor 87 with higher order modes in unselected portions thereof. An E field 95, represented by arrows from RF energy propagating toward and away from cavity 90, is shown between inner conductor 85 and outer conductor 84. End conductor 87 is coupled to outer conductor 84 and is spaced from inner conductor 85 to form cavity 90. Selected portions 92*b* of inner conductor 85 and end conductor 87 have switch means 80*b* activated, thereby electrically coupling a selected portion of inner conductor 85 to a selected portion of outer conductor. No significant electrical potential will exist between those selected portions 92*b*, therefore no E field is shown between those selected portions 92*b*. But where switch means 80*a* is not activated, those unselected portions 92*a* of inner conductor 85 and end conductor 87 will have different potentials, therefore an E field 95 is shown. By having RF energy in these unselected portions 92*a*, higher order modes exist, a predetermined reflection coefficient will exit in the phase shifter 20 and a predetermined phase shift, related to the predetermined reflection coefficient, will be imparted between RF energy entering and exiting the phase shifter 20. The lowest order mode is having all portions unselected, so that the E field 95 is uniformly distributed between all portions of inner conductor 85 and endplate 87. By selectively enabling switch means 80 (FIG. 6), a selected one of a plurality of predetermined phase shifts can be imparted between RF energy entering phase shifter 20 and reflected radio frequency energy exiting the phase shifter 20 by having selected portions of the inner conductor 85 electrically coupled to selected portions of end conductor 87 by switch means 80*b* causing those selected portions 92*b* to have substantially the same electrical potential, while unselected portions 92*a* have different electrical potentials. Selecting different portions causes different higher order modes which form different reflection coefficients in phase shifter 20 and, hence, different predetermined phase shifts between RF energy entering phase shifter 20 and exiting therefrom.

Having described a preferred embodiment of the invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A phase shifter wherein radio frequency energy is fed into an input/output port of such phase shifter and then coupled from such phase shifter at the input/output port, such phase shifter providing one of a plurality of predetermined phase shift between the fed energy and the coupled energy selectively in accordance with a control signal, such phase shifter comprising:

a coaxial transmission line having a uniform inner conductor and an outer conductor, a first end of the uniform inner conductor and a first end of the outer conductor providing the input/output port of the phase shifter;

a conductor connected to the second end of the outer conductor, such conductor being dielectrically spaced from a second end of the uniform inner conductor; and a plurality of switch means, disposed between different portions of the second end of the uniform inner conductor and the conductor in response to a control signal, for electrically connecting a selected one or ones of said different portions of the second end of the uniform inner conductor directly to the conductor while unselected ones of said different portions of the second end of the uniform inner conductor remain dielectrically spaced from said conductor.

2. A phase shifter as recited in claim 1 wherein each of the plurality of switch means is a PIN diode.

3. A reflective type phase shifter for imparting a predetermined phase shift between radio frequency energy entering the reflective type phase shifter and exiting therefrom after being reflected therein, the reflective type phase shifter comprising:

a coaxial transmission line having a uniform inner conductor and an outer conductor, a first end providing an input to enter the radio frequency energy and providing an output to exit the reflected, phase shifted radio frequency energy;

an end conductor coupling to a second end of the outer conductor spaced from a second end of the inner conductor a predetermined distance; and a plurality of switch means, disposed between selected portions of the end of the uniform inner conductor and corresponding selected portions of the end conductor, for electrically coupling the selected portions of the uniform inner conductor directly to the selected portions of the end conductor in accordance with corresponding control signals.

4. A reflective type phase shifter as recited in claim 3 further comprising:

a plurality of serially coupled quarter-wave transformer means for electrically transforming radio frequency energy from a relatively high impedance input to a relatively low impedance output;

means, coupling to a first one of the plurality of serially coupled quarter-wave transformer means, for entering therein and exiting therefrom radio frequency energy;

a last one of the plurality of serially coupled quarter-wave transformer means coupling to the first end of the coaxial transmission line; and wherein the coaxial transmission line has substantially the same characteristic impedance as the relatively low impedance output of the last one of the plurality of serially coupled quarter-wave transformer means.

5. A reflective type phase shifter as recited in claim 4 wherein:

the plurality of quarter-wave serially coupled transformer means are three serially coupled quarter-wave transformers;

wherein a first one of the three serially coupled quarter-wave transformers being concentric with a second one of the three serially coupled quarter-wave transformers and an outer conductor of the first one of the three serially coupled quarter-wave transformers being in common with an inner conductor of the second one of the three serially coupled quarter-wave transformers;

the first and second ones of the three serially coupled quarter-wave transformers being concentric with a third one of the three serially coupled quarter-wave transformers and an inner conductor of the third one of the three serially coupled quarter-wave transformers being in common with an outer conductor of the second one of the three serially coupled quarter-wave transformers.

6. A reflective type phase shifter as recited in claim 3 wherein the plurality of switch means are a plurality of PIN diodes.

7. A reflective type phase shifter as recited in claim 3 wherein the inner perimeter of the second end of the outer conductor is less than one-half wavelength.

8. A phase shifter as recited in claim 5 wherein the coaxial transmission line and the three serially coupled quarter-wave transformers are cylindrical, and the plurality of switch means are arranged axially and symmetrically between an outer periphery of the second end of the uniform inner conductor and corresponding portions of the end conductor.

9. A reflective type phase shifter for imparting predetermined phase shift between radio frequency energy entering the reflective type phase shifter and exiting therefrom after being reflected therein, the reflective type phase shifter comprising:

a coaxial transmission line having a uniform inner conductor and a uniform outer conductor, a first end providing an input to enter the radio frequency energy and providing an output to exit the reflected, phase shifted radio frequency energy;

an endplate coupling to a second end of the outer conductor and spaced from a second end of the uniform inner conductor a predetermined distance; and a plurality of switch means, disposed between selected portions of the second end of the uniform inner conductor and corresponding selected portions of the endplate for electrically coupling the selected portions of the uniform inner conductor to the selected portions of the endplate in accordance with control signals to place such selected portions of the uniform inner conductor and such selected portions of the endplate at substantially the same electrical potential while unselected portions are at different electrical potentials.

10. A reflective type phase shifter as recited in claim 9 wherein the end conductor coupling to the second end of the outer conductor and spaced from the second end of the uniform inner conductor a predetermined distance forms a cavity non-resonant at a nominal operating frequency of the phase shifter.

11. A reflective type phase shifter as recited in claim 10 wherein each of the plurality of switch means is a PIN diode.

12. A phase adjusting network comprising:

a plurality of pairs of reflective type phase shifters; and a corresponding plurality of successively coupled coupling means, each of the plurality of successively coupled coupling means having an input port, a pair of output ports and a terminating port, the input port of a first one of the plurality of coupling means coupling to an input of the network, an input port of a succeeding one of the plurality of successively coupling coupling means coupling to a terminating port of a preceding one of the plurality of successively coupling coupling means, a terminating output port of a last one of the successively coupling plurality of coupling means couple to an output of the network, and the reflective type phase shifters of each pair thereof being coupled to the pair of output ports of a corresponding one of the plurality of coupling means, for phase shifting the radio frequency energy in the plurality of reflective phase shifters as such energy passes from the network input to the network output;

wherein each of the reflective type phase shifters comprises:

(i) a plurality of serially coupled quarter-wave transformers for electrically transforming radio frequency energy from a relatively high impedance input to a relatively low impedance output, a first one of the plurality of serially coupled quarter-wave transformers being coupled to a corresponding one of the pair of output ports of a corresponding one of the plurality of coupling means;

(ii) a coaxial transmission line having cylindrical inner and outer conductors, a first end coupled to the relatively low impedance output of a last one of the plurality of serially coupled quarter-wave transformers and having substantially the same characteristic impedance as the relatively low impedance output of the last one of the three serially coupled quarter-wave transformers;

(iii) an endplate coupling to a second end of the outer conductor and spaced from a second end of the inner conductor a predetermined distance;

(iv) the inner circumference of the outer conductor of a second end of the coaxial transmission line being less than one-half wavelength; and (v) a plurality of switch means, disposed between selected portions of the second end of the inner conductor and corresponding selected portions of the endplate in the non-resonant cavity for electrically coupling the selected portions of the inner conductor to the selected portions of the endplate in accordance with control signals to place such selected portions of the inner conductor and such selected portions of the endplate at substantially the same electrical potential while unselected portions are at different electrical potentials.

13. A phase adjusting network as recited in claim 12 wherein the plurality of pairs of reflective type phase shifters are two pairs of reflective type phase shifters, the plurality of coupling means are two hybrids, and each of the plurality of switch means are PIN diodes.

14. A phase adjusting network as recited in claim 12 wherein each pair of reflective type phase shifters has common control signals.

* * * * *